US009138619B2

(12) United States Patent
Takechi

(10) Patent No.: US 9,138,619 B2
(45) Date of Patent: Sep. 22, 2015

(54) GOLF CLUB HEAD

(71) Applicant: BRIDGESTONE SPORTS CO., LTD., Minato-Ku, Tokyo (JP)

(72) Inventor: Takaharu Takechi, Minato-ku (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 8 days.

(21) Appl. No.: 14/048,891

(22) Filed: Oct. 8, 2013

(65) Prior Publication Data

US 2014/0155193 A1 Jun. 5, 2014

(30) Foreign Application Priority Data

Dec. 5, 2012 (JP) ..... 2012-266456

(51) Int. Cl.
*A63B 53/04* (2015.01)
*A63B 49/06* (2006.01)

(52) U.S. Cl.
CPC ..... *A63B 53/0466* (2013.01); *A63B 49/06* (2013.01); *A63B 2053/045* (2013.01); *A63B 2053/0408* (2013.01); *A63B 2053/0433* (2013.01); *A63B 2053/0437* (2013.01); *A63B 2209/00* (2013.01)

(58) Field of Classification Search
CPC ..... A63B 53/0466; A63B 2209/00; A63B 2053/045; A63B 2053/0433; A63B 2053/0408; A63B 2053/0437; A63B 49/06
USPC ..... 473/324–350, 287–292
See application file for complete search history.

(56) References Cited

U.S. PATENT DOCUMENTS

| | | | | | |
|---|---|---|---|---|---|
| 5,090,702 | A * | 2/1992 | Viste | 473/331 |
| 5,601,501 | A * | 2/1997 | Kobayashi | 473/350 |
| 5,611,742 | A * | 3/1997 | Kobayashi | 473/345 |
| 5,676,605 | A * | 10/1997 | Kobayashi | 473/331 |
| 6,001,029 | A * | 12/1999 | Kobayashi | 473/327 |
| 6,299,548 | B1 * | 10/2001 | Lin | 473/331 |
| 6,322,459 | B1 * | 11/2001 | Nishimura et al. | 473/330 |
| 6,783,465 | B2 * | 8/2004 | Matsunaga | 473/329 |
| 6,852,038 | B2 * | 2/2005 | Yabu | 473/224 |
| 7,108,614 | B2 * | 9/2006 | Lo | 473/345 |
| 7,510,485 | B2 * | 3/2009 | Yamamoto | 473/345 |
| 7,914,394 | B2 * | 3/2011 | Cole et al. | 473/332 |
| 8,439,769 | B2 * | 5/2013 | Rice et al. | 473/329 |
| 8,540,590 | B2 * | 9/2013 | Tsukada et al. | 473/345 |
| 8,777,778 | B2 * | 7/2014 | Solheim et al. | 473/346 |
| 2004/0192468 | A1 * | 9/2004 | Onoda et al. | 473/345 |
| 2005/0037861 | A1 * | 2/2005 | Kobayashi | 473/345 |
| 2005/0096154 | A1 * | 5/2005 | Chen | 473/345 |
| 2005/0143189 | A1 * | 6/2005 | Lai et al. | 473/335 |
| 2008/0045356 | A1 * | 2/2008 | Lin et al. | 473/346 |
| 2011/0039636 | A1 * | 2/2011 | Cackett et al. | 473/342 |
| 2012/0178550 | A1 * | 7/2012 | Solheim et al. | 473/346 |

FOREIGN PATENT DOCUMENTS

| | | |
|---|---|---|
| JP | 2007-054200 A | 3/2007 |
| JP | 2011-030836 A | 2/2011 |

* cited by examiner

*Primary Examiner* — Sebastiano Passaniti
(74) *Attorney, Agent, or Firm* — Sughrue Mion, PLLC

(57) ABSTRACT

A golf club head includes: a face portion; a crown portion, furrows being formed on an interior surface of at least a part of the crown part in a mesh-like pattern; a side portion; a sole portion, at least a front part of the sole portion being made of metal, and furrows being formed on an interior surface of at least a part of the front part in a mesh-like pattern; and a hosel portion.

13 Claims, 6 Drawing Sheets

GOLF CLUB HEAD

CROSS-REFERENCE TO RELATED APPLICATION

This Application claims priority from Japanese Patent Application No. 2012-266456 filed Dec. 5, 2012, which is incorporated herein by reference in its entirety.

BACKGROUND OF THE INVENTION

The present invention relates to a hollow golf club head, more particularly to a golf club head, at least the front part of a sole portion of which is made of metallic plate so as to adjust stiffness of the front part of the sole portion.

Hollow, metallic golf club heads have been widely used as a wood-type golf club such as a driver and a fairway wood. Generally, the hollow wood type golf club head includes a face portion for hitting a ball, a crown portion which constructs a top surface portion of the gold club head, a sole portion which constructs a bottom surface portion of the golf club head, a side portion which constructs a toe side, a back side and a heel side of the golf club head, and a hosel portion. A shaft is inserted into the hosel portion and is fixed thereto with adhesive or the like.

Although as a metal material for constructing the hollow golf club head, aluminum alloy, stainless steel, and titanium alloy have been used, in particular, titanium alloy has been widely used in recent years.

Japanese Patent Application Publication No. 2007-054200 discloses a golf club head in which the back side and the face side of the sole portion is formed with a large thickness whereas an area therebetween is formed with a small thickness. Japanese Patent Application Publication No. 2011-030836 discloses a golf club head in which the heel side of the sole portion is made with a large thickness whereas a toe side of the sole portion is made with a small thickness.

SUMMARY OF THE INVENTION

If a thick portion and a thin portion are provided in the sole portion, stress generated upon impact when a ball is hit is concentrated to a boundary between the thick portion and the thin portion. Thus, it is necessary to adopt a material having sufficient strength as a construction material of the head so that the freedom of choice of the material is reduced.

An object of the present invention is to provide a golf club head which enables stiffness distribution of a front part of a sole portion and a crown portion to be achieved as specified by design values easily.

Furthermore, another object of the present invention is to provide a golf club head which enables stiffness distribution of a face portion to be achieved as specified by design values easily.

A golf club head of the present invention includes: a face portion; a crown portion, furrows being formed on an interior surface of at least a part of the crown part in a mesh-like pattern; a side portion; a sole portion, at least a front part of the sole portion being made of metal, and furrows being formed on an interior surface of at least a part of the front part in a mesh-like pattern; and a hosel portion.

The mesh-like pattern of the furrows may include a polygonal pattern. The term "polygonal pattern" includes a plurality of polygonal shapes having at least three sides and angles, for example, triangles, quadrangles, pentangles, hexagons, heptagons, or polygons having more angles, or any combination thereof.

The furrow may have a depth of 10 to 40% of the average thickness of the front part of the sole portion except the furrows and may have a width of 0.1 to 0.6 mm.

In an embodiment of the present invention, the furrows may be formed only on a toe side and a heel side of the front part of the sole portion. In another embodiment of the present invention, the furrows may be entirely formed on the front part of the sole portion so that an average area of polygons in the polygonal pattern is larger on a central area of the front part than on a toe side and a heel side of the front part.

The furrows of the crown portion may be formed on a front part thereof.

Furthermore, furrows may be formed on at least a part of an interior surface of the face portion in a mesh-like pattern. The furrows of the face portion may be formed on a toe side and a heel side of the interior surface thereof. Alternatively, the furrows of the face portion may be entirely formed on the interior surface thereof so that an average area of polygons in the polygonal pattern is larger on a central area of the face portion than on a toe side and a heel side of the face portion.

According to a golf club head of the present invention, the furrows are formed on the interior surface of the front part of the sole portion and on the crown portion, and thus, stiffness of these portions can be desirably adjusted.

According to the present invention, in case in which the furrows are formed only on the toe side and the heel side of the front part of the sole portion, stiffness of these portions is lower than the central portion of the front part of the sole portion. Thus, when a ball is hit with the toe side relative to the face center, distortion of the toe side of the face surface is larger than that of the central portion, so that counterclockwise spin (i.e., hook spin) is likely to be applied to the ball. Consequently, when the ball is hit with the toe side, hook or draw is applied to the ball launched slightly rightward (for a right-handed player), so that the ball is likely to go back to the fairway center.

In contrast, if the ball is hit with the heel side relative to the face center, distortion of the heel side of the face surface is larger than that of the central portion, so that counterclockwise spin (i.e., slice spin) is likely to be applied to the ball. Thus, when the ball is hit with the heel side, slice or fade is applied to the ball launched slightly leftward (for a right-handed player), so that the ball is likely to go back to the fairway center.

In case in which the furrows are entirely formed on the front part of the sole portion so that the average area of polygons in the polygonal pattern is larger on the central area thereof than on the toe and heel sides thereof, the same effect as described above can be obtained.

According to the golf club head of the present invention, by forming the furrows on the crown portion, at an impact time when the ball is hit, the crown portion can be distorted so that the ball launching angle can increase. Consequently, if a player whose head speed is low strikes the ball, the ball flying distance can be increased.

According to the present invention, by forming furrows only on the toe and heel sides of the interior surface of the face portion, the operation and effect described above can be further remarkably improved. Alternatively, by entirely forming furrows on the interior surface of the face portion so that the average area of polygons in the polygonal pattern is greater on the central area of the face portion than on the toe and heel sides of the face portion, the operation and effect described above also can be further remarkably improved.

DETAILED DESCRIPTION OF THE PREFERRED EMBODIMENT

Figure 1A:
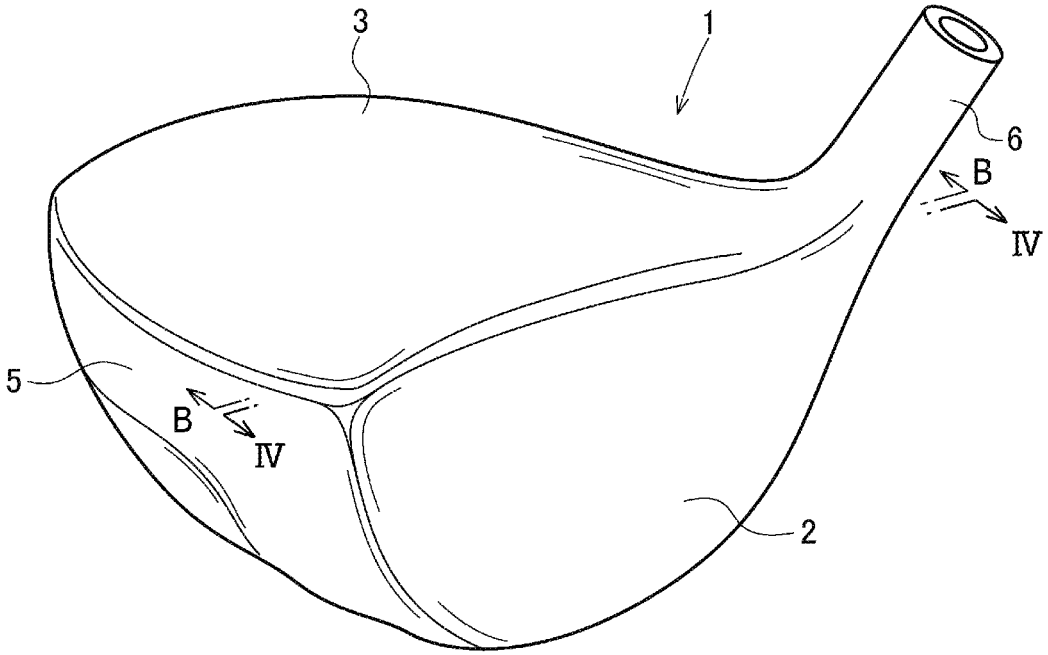
FIG. 1A is a perspective view showing an embodiment of a golf club head according to the present invention.

Hereinafter, preferred embodiments of the present invention will be described with reference to the drawings.

A golf club head 1 is a hollow driver head which includes a face portion 2, a crown portion 3, a sole portion 4, a side portion 5, and a hosel portion 6. The golf club head 1 is made of titanium or titanium alloy. A face surface of the face portion 2 is provided with scoring lines (not shown).

Figure 1B:
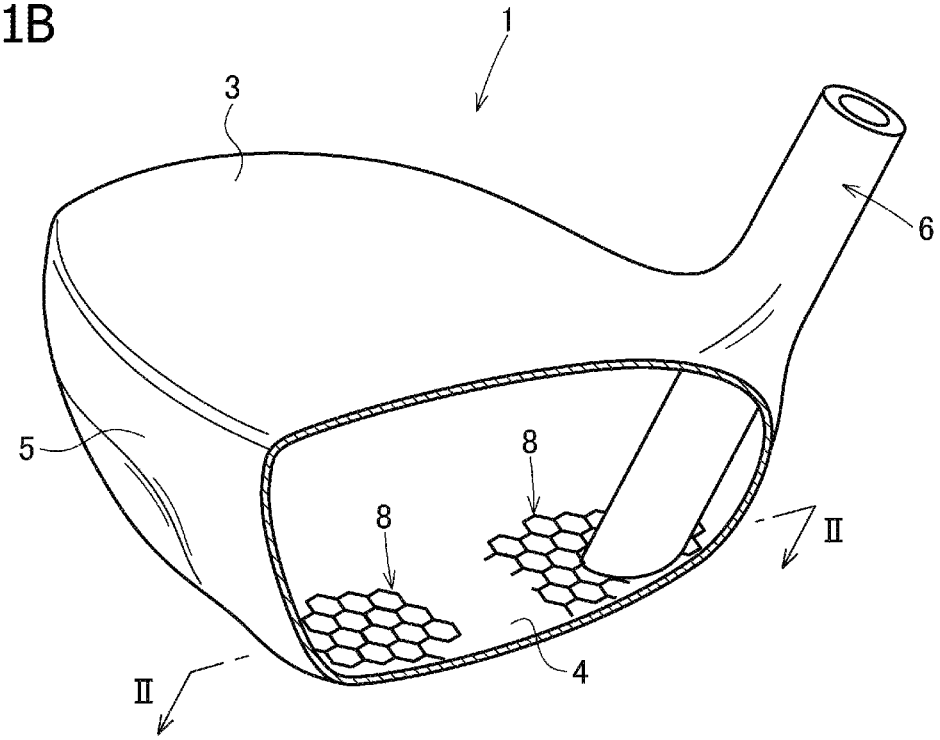
FIG. 1B is a cross-sectional view taken along the line B-B in FIG. 1A.
Figure 2:
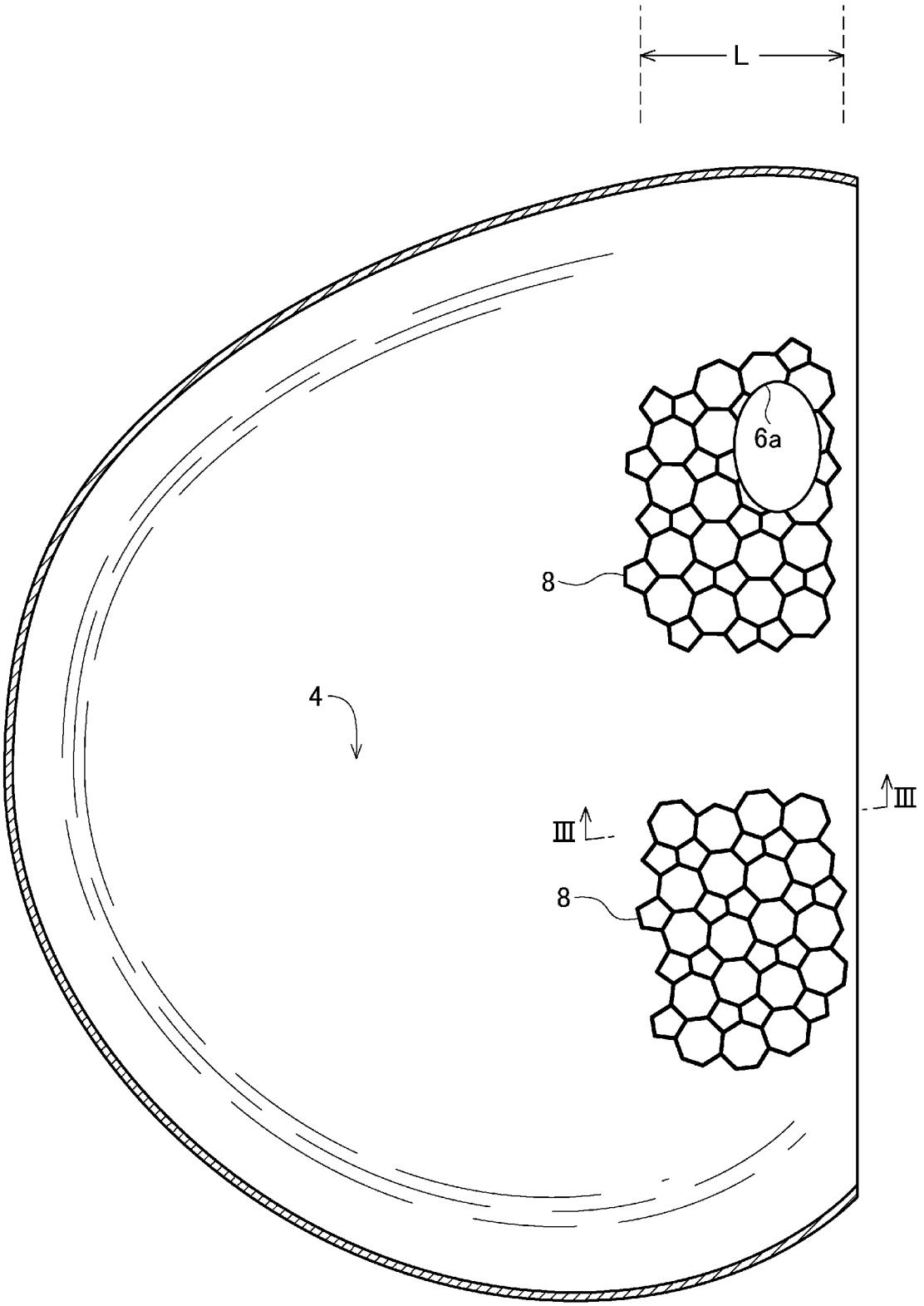
FIG. 2 is a cross-sectional view taken along the line II-II in FIG. 1B.
Figure 3:
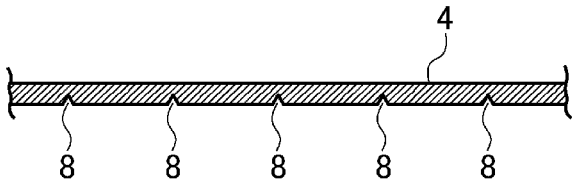
FIG. 3 is a cross-sectional view taken along the line III-III in FIG. 2.

As shown in FIGS. 1B and 2, furrows 8 are extended on a front part of an interior surface of the sole portion 4 in a mesh-like pattern such that they draw a honeycomb-like pattern in which polygons having at least three angles such as a triangle and a quadrangle are combined. The thickness of areas other than the furrows 8 in the front part of the sole portion is preferred to be 0.5 to 1.0 mm, more preferably 0.6 to 0.8 mm. The depth of the furrow 8 is preferred to be 10 to 40% the above thickness, more preferably 15 to 30%. The width of the furrow 8 is preferred to be 0.1 to 0.6 mm, more preferably 0.2 to 0.3 mm. An average area of the polygon surrounded by the furrows 8 is 10 to 150 $mm^2$, more preferably 15 to 100 $mm^2$, but the present invention is not limited to these ranges.

Although a width L in a back and forth direction of the area provided with the furrows 8 is 15 to 40 mm, more preferably 20 to 30 mm, but the present invention is not limited to these ranges.

According to the present embodiment, the furrows 8 are formed on the toe side and the heel side of the front part of the interior surface of the sole portion 4. The width of each area in the toe-heel direction provided with the furrows 8 on the toe side and the heel side is 40 to 95% the maximum width in the toe-heel direction of the face portion 2, preferably 60 to 80%, but the present invention is not limited to these ranges.

Preferably, a press die for forming the sole portion 4 is provided with projections for forming the furrows 8 and the furrows 8 are formed at the same time when pressing is executed.

Figure 4:
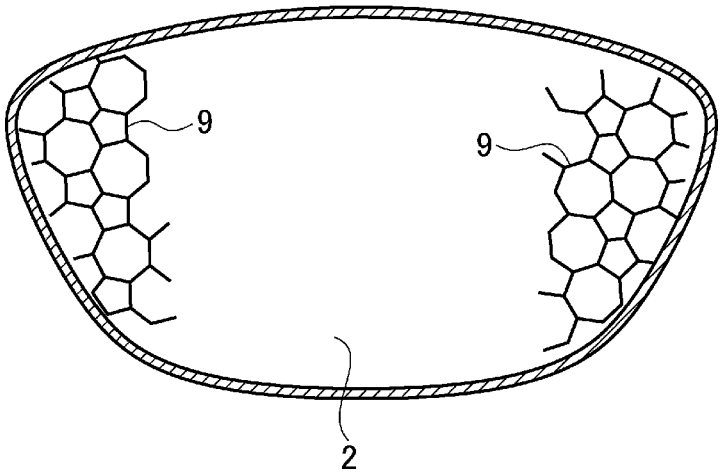
FIG. 4 is a view taken along the line IV-IV in FIG. 1A.
Figure 5:
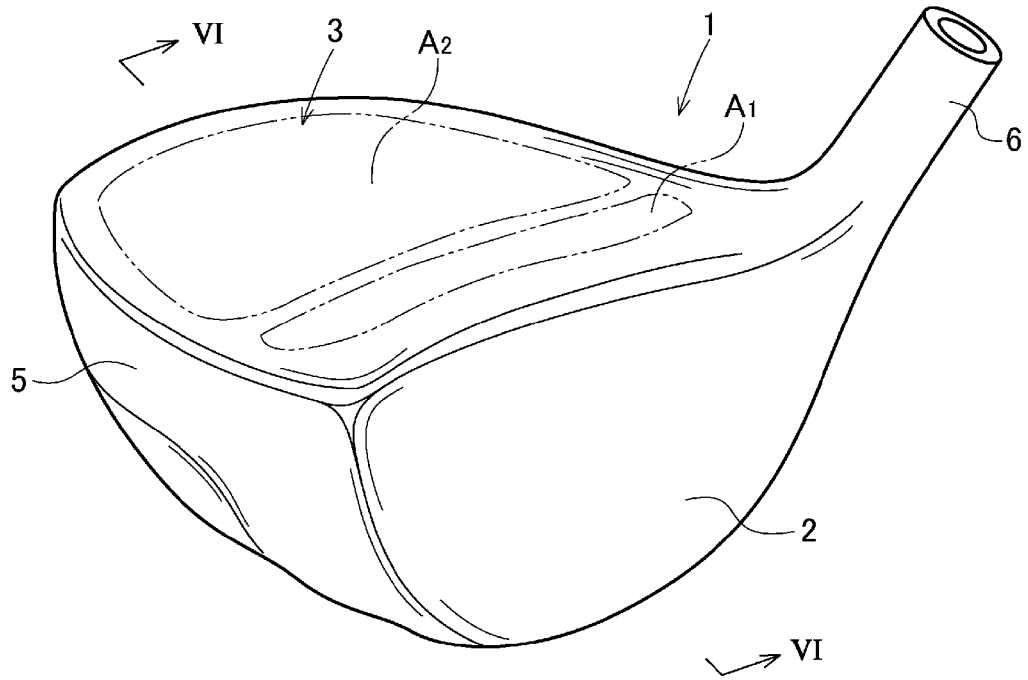
FIG. 5 is another perspective view showing the a golf club head shown in FIG. 1A.
Figure 6:
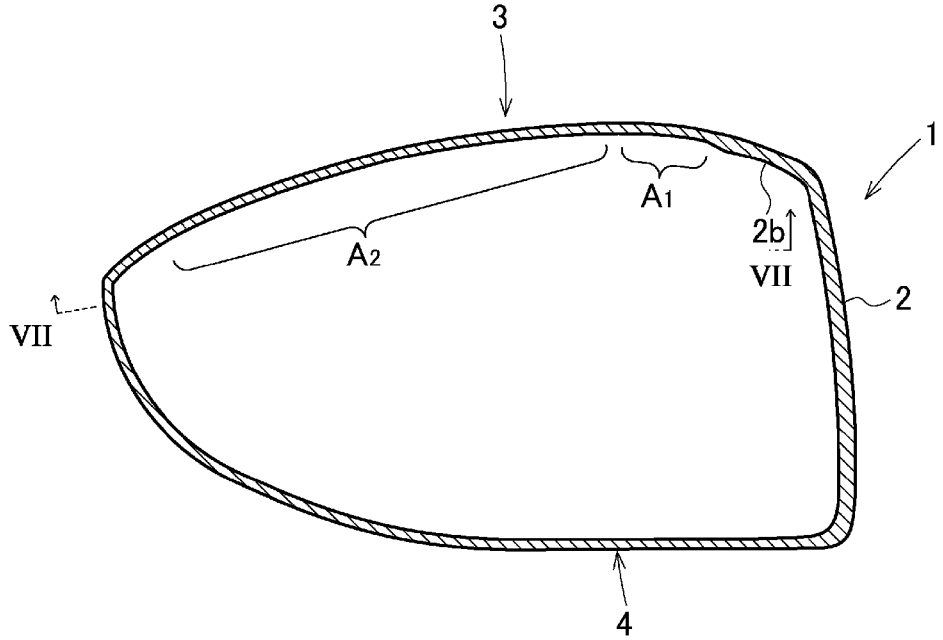
FIG. 6 is a cross-sectional view taken along the line VI-VI in FIG. 5.

According to the present embodiment, as shown in FIG. 4, the interior surface (rear surface) on the toe side and the heel side of the face portion are provided with the furrows 9. A preferable providing mode for the furrows 9 is the same as for the furrows 8.

In the present embodiment, as shown in FIGS. 5 to 9, a front edge side of the interior surface (ceiling surface of the hollow portion of the hollow golf club head 1) of the crown portion 3 is formed as furrow forming area $A_1$, and most of the part (main central area except a crown periphery) behind the furrow forming area $A_1$ is formed as dent forming area $A_2$.

Figure 7:
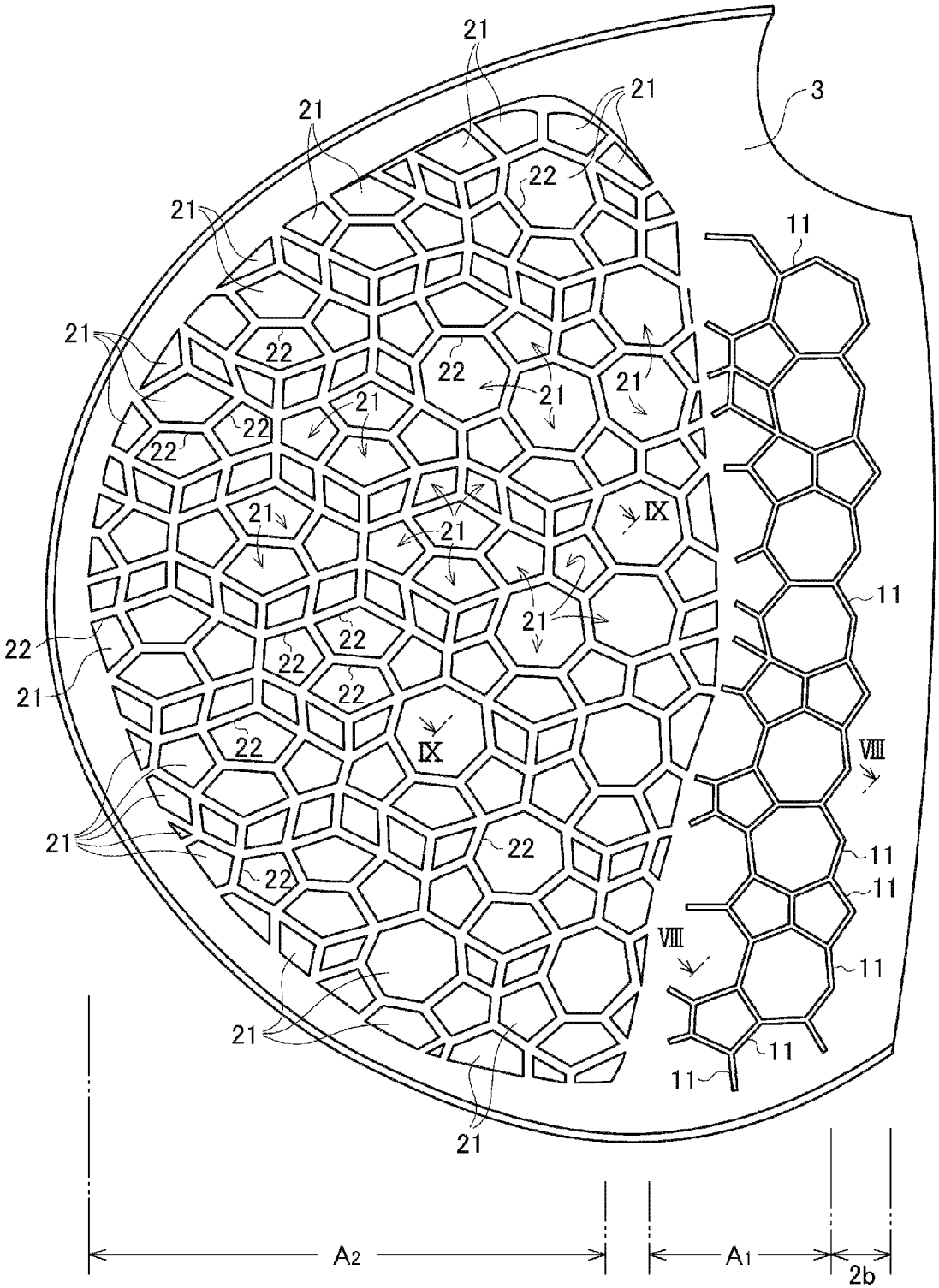
FIG. 7 is a cross-sectional view taken along the line VII-VII in FIG. 6.
Figure 9:
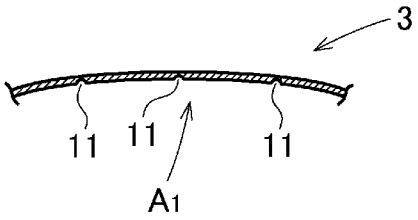
FIG. 9 is a cross-sectional view taken along the line IX-IX in FIG. 7.

As shown in FIGS. 7 and 9, the furrows 11 are extended in the furrow forming area $A_1$ in the mesh-like pattern such that they draw a honeycomb-like pattern in which polygons having at least three angles such as a triangle and a quadrangle are combined. The thickness of the furrow forming area $A_1$ except the furrows 11 is preferred to be 0.5 to 1 mm, more preferably 0.6 to 0.8 mm. The depth of the furrow 11 is preferred to be 10 to 40% the above-mentioned depth, more preferably 15 to 30%. The width of the furrow 11 is preferred to be 0.1 to 0.6 mm, more preferably 0.2 to 0.3 mm. The average area of the polygon surrounded by the furrow 11 is preferred to be 10 to 150 $mm^2$, more preferably 15 to 100 $mm^2$, but the present invention is not limited to these ranges.

No furrow is formed in an area adjacent the face portion 2 relative to the furrow forming area $A_1$ of the crown portion 3 and a flat area is provided. In addition, no furrow is formed in an area around the hosel, and instead, a flat area is provided.

The average width in the back and forth direction of the furrow forming area $A_1$ is preferred to be 15 to 40 mm, and more preferably 20 to 30 mm. The width in the toe-heel direction of the furrow forming area $A_1$ is preferred to be 60 to 95% the maximum width in the toe-heel direction of the face portion 2, more preferably 70 to 80%.

Figure 8:
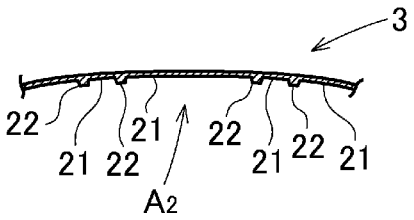
FIG. 8 is a cross-sectional view taken along the line VIII-VIII in FIG. 7.

As shown in FIGS. 7 and 8, in the dent forming area $A_2$, a plurality of dents 21 of a polygon having at least three angles, such as a triangle or a quadrangle, are formed while convexity 22 is formed between the dents 21 so as to combine the dents 21. The convexities 22 are extended in a mesh-like pattern such that they draw the honeycomb pattern in which polygons having at least three angles, such as a triangle and a quadrangle, are combined.

The thickness of the crown portion at the dent 21 is preferred to be 0.3 to 0.8 mm, and more preferably 0.4 to 0.6 mm. The height of the convexity 22 from the dent 21 is preferred to be 0.1 to 0.4 mm, and more preferably 0.15 to 0.3 mm. The width of the convexity 22 is preferred to be 0.2 to 0.8 mm, and more preferably 0.3 to 0.6 mm. The average area of the dent 21 is preferred to be 10 to 150 $mm^2$, and more preferably 15 to 100 mm.

No dent is formed in the peripheries on the toe side, the heel side and the back side of the dent forming area $A_2$ of the crown portion 3, and instead, a flat area is provided. Although the thickness of the periphery of the crown portion 3 is preferred to be equal to the thickness of the convexity 22, it may be slightly larger than the convexity 22.

The area of the dent forming area $A_2$ is preferred to be 50 to 90% the area of the crown portion 3, more preferably 60 to 80%. The dent 21 is preferred to be formed by chemical milling. In the chemical milling, a titanium plate or titanium alloy plate is pressed to prepare a raw plate. Of the interior side of the raw plate, an area excluding the dents 21 is masked. As the masking material, paint such as acrylic resin is preferable. After that, the raw plate is processed by chemical milling using titanium etching solution such as a mixture of hydrofluoric acid and nitric acid. At this time, preferably, with the exterior surface of the raw plate entirely masked, the raw plate is dipped in etching solution and processed by chemical milling. After the chemical milling processing, the masking material is removed from the raw plate, so that as shown in FIG. 7, the dent forming area $A_2$ is formed.

In the golf club head having the above-described structure, the furrows 8 are provided on the toe side and the heel side of the front part of the sole portion 4, and thus, stiffness of those areas is lower than the central portion of the front part of the sole portion 4. Consequently, when a ball is hit with the toe side relative to the face center, distortion of the toe side of the face surface is larger than the central side, so that the hook spin is likely to be applied to the ball. Thus, when the ball is hit with the toe side, hook or draw is applied to the ball launched slightly rightward (for a right-handed player), so that the ball is likely to go back to the fairway center.

In contrast, if the ball is hit with the heel side relative to the face center, distortion of the heel side of the face surface is larger than at the central portion, so that the slice spin is likely to be applied to the ball. Thus, when the ball is hit with the heel side, slice or fade is applied to the ball launched slightly leftward (for a right-handed player), so that the ball is likely to go back to the fairway center side.

According to the present embodiment, as shown in FIG. 4, by forming the furrows 9 on the toe and heel sides of the rear surface of the face portion, the above-described operation and effect can be further remarkably provided. Particularly, by forming the furrows 9 on the face portion so that the depth and width of the furrows and the area of the polygon surrounded by the furrows meet the above-described ranges, the above-described operation and effect can increase.

In the golf club head 1, the crown portion 3 has the furrow forming area $A_1$ on which the furrows 11 are formed and the dent forming area $A_2$ on which a plurality of the dents 21 is formed so that stiffness of the crown portion 3 is low. Thus, upon an impact time when the ball is hit, the crown portion 3 is distorted easily so that the ball launching angle can be increased. Consequently, if a player whose head speed is low uses this golf club head, his or her ball flying distance can be increased. Particularly, in the present embodiment, the dent forming area $A_2$ has mesh-like dent 22 structure so that a force applied from the face side is transmitted to the entire dent forming area $A_2$. As a result, substantially the entire crown portion 3 is distorted, thereby improving the above-described effect.

Particularly, because the dents of the crown portion 3 are formed in the above dimensions, the convexity and the furrows 11 are formed in the above height, depth and width, the area of the polygon surrounded by the furrows is set in the above dimensions, and the areas of the dent forming area $A_2$ and the furrow forming area $A_1$ are set in the above range, the above-described effect is improved.

According to the present embodiment, the forefront area along the face surface of the crown is a thick flat area having no furrows. Thus, the face portion is reinforced and even when a ball is hit with the toe side or the heel side, an impact is transmitted entirely in the width direction of the crown portion 3 effectively. Furthermore, an intermediate portion between the thick crown forefront area and the dent forming area $A_2$ is the furrow forming area $A_1$ and the stiffness thereof is intermediate between both. Thus, no stress is concentrated to the boundary between the crown forefront area and the dent forming area $A_2$, and durability of the crown portion 3 is excellent.

According to the present embodiment, by providing the furrows, the stiffness distribution of the front part of the sole portion 4 and the crown portion 3 and the face portion is adjusted, and there is no step difference as in a case in which a thick portion and a thin portion are provided. As a consequence, no stress is concentrated at any local area. Thus, a demanded strength of the material is relaxed so that choices of a titanium based metallic material may be expanded.

Although according to the present embodiment, the furrows 8, 9 are provided on the toe side and the heel side of the front part of the sole portion 4 and the interior surface of the face portion 2, it is permissible to provide the furrow 8 entirely on the front part of the sole portion 4 and to provide the furrow 9 entirely on the face portion 2. In this case, by selecting the area of the triangles or other polygons drawn by the furrows 8, 9 in various ways (for example, increasing the area of the triangles or other polygons in the front part of the sole portion and the central area of the face portion 2 while reducing the area of the triangles or other polygons on the toe side and the heel side), the same effect as described above can be obtained.

The above-described embodiment is just an example of the present invention and the present invention may be constructed in other embodiments than shown here. For example, the pattern drawn by the furrows 8, 9, 11 may be of an irregular mesh shape or may be of a regular mesh shape.

According to the present invention, part of the golf club except the face portion and the sole portion may be constructed of fiber-reinforced synthetic resin.

What is claimed is:

1. A golf club head comprising:

a face portion;

a crown portion, furrows being formed on an interior surface of at least a part of the crown part in a mesh-like pattern;

a side portion;

a sole portion, at least a front part of the sole portion being made of metal, and furrows being formed on an interior surface of at least a part of the front part in a mesh-like pattern; and a hosel portion, wherein the furrows of the crown portion are formed on a front part thereof, and a dent forming area having a plurality of dents is formed behind the furrows of the crown portion, wherein furrows are further formed on at least a part of an interior surface of the face portion in a mesh-like pattern, wherein the mesh-like pattern of the furrows of the face portion comprises a polygonal pattern, and the furrows of the face portion are entirely formed on the interior surface thereof so that the average area of polygons in the polygonal pattern is larger on a central area of the face portion than on a toe side and a heel side of the face portion.

2. The golf club head according to claim 1, wherein the mesh-like pattern of the furrows comprises a polygonal pattern.

3. The golf club head according to claim 2, wherein the furrow has a depth of 10 to 40% of an average thickness of the front part of the sole portion except the furrows and has a width of 0.1 to 0.6 mm.

4. The golf club head according to claim 2, wherein the furrows are entirely formed on the front part of the sole portion so that the average area of polygons in the polygonal pattern is larger on a central area of the front part than on a toe side and a heel side of the front part.

5. The golf club head according to claim 1, wherein the furrows are formed on a toe side and a heel side of the front part of the sole portion.

6. The golf club head according to claim 1, wherein the furrows are formed on a toe side and a heel side of the interior surface of the face portion.

7. The golf club head according to claim 1, wherein a plurality of dents of a polygon are further formed in the dent forming area.

8. The golf club head according to claim 1, wherein the dent forming area further has convexities combining the dents.

9. The golf club head according to claim 8, wherein the convexities are a mesh-like pattern.

10. The golf club head according to claim 8, wherein the convexities have a height of 0.1 to 0.4 mm from a surface of the dent forming area, and the convexities have a width of 0.2 to 0.8 mm.

11. The golf club head according to claim 1, wherein the crown portion has a thickness of 0.3 to 0.8 mm at the dent forming area.

12. The golf club head according to claim 1, wherein the dent forming area has an area of 50 to 90% of an area of the crown portion.

13. The golf club head according to claim 1, wherein no furrow is formed in an area adjacent the face portion relative to an area where furrows are formed in the crown portion and a flat area is provided in the area adjacent the face portion.

* * * * *